US007360333B2

(12) United States Patent
Kim

(10) Patent No.: US 7,360,333 B2
(45) **Date of Patent: *Apr. 22, 2008**

(54) ACCESSORY DEVICES FOR FIREARMS

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 12 days.

This patent is subject to a terminal disclaimer.

(21) Appl. No.: 11/436,293

(22) Filed: May 17, 2006

(65) Prior Publication Data

US 2007/0074444 A1 Apr. 5, 2007

Related U.S. Application Data

(63) Continuation of application No. 10/819,535, filed on Apr. 6, 2004, now Pat. No. 7,117,624.

(51) Int. Cl.
*F41C 23/00* (2006.01)

(52) U.S. Cl. ..... 42/85; 42/190; 42/124; 42/113; 89/200; 362/110

(58) Field of Classification Search ..... 42/85, 42/190, 124, 113; 89/200; 362/110
See application file for complete search history.

(56) References Cited

U.S. PATENT DOCUMENTS

| | | | |
|---|---|---|---|
| 689,547 | A | 12/1901 | James |
| 894,306 | A | 7/1908 | Wright |
| 933,095 | A | 9/1909 | Mosteller |
| 957,299 | A | 5/1910 | Barnes |
| 958,332 | A | 5/1910 | Snyder |
| 982,280 | A | 1/1911 | Lewis |
| 1,120,769 | A | 12/1914 | Villarejo |
| 1,149,705 | A | 8/1915 | Ward |
| 1,215,171 | A | 2/1917 | Lewis |
| 1,222,778 | A | 4/1917 | McCleary |
| 1,262,270 | A | 4/1918 | Schmidt et al. |
| 1,263,667 | A | 4/1918 | Henderson et al. |
| 1,338,239 | A | 4/1920 | Matys |
| 1,427,042 | A | 8/1922 | Wetmore |
| 1,452,651 | A | 4/1923 | Norrlin |

(Continued)

FOREIGN PATENT DOCUMENTS

| | | |
|---|---|---|
| AT | 274620 | 12/1968 |

(Continued)

OTHER PUBLICATIONS

Insight Technology, "M3X Operator's Manual" (24 pages), dated Jul. 2003.

(Continued)

*Primary Examiner*—J. Woodrow Eldred
(74) *Attorney, Agent, or Firm*—David Weiss

(57) ABSTRACT

An accessory device for being mounted to a longitudinal rail carried by a firearm and accommodating longitudinal rails of different configurations. A preferred embodiment comprises a light beam generator including a housing, elongate members removably secured to the housing and complementing the rail for enabling the housing to be retainably slid along the rail, a latch plate pivotally and removably secured to the rail, and a replaceable ambidextrous tail cap switch.

36 Claims, 5 Drawing Sheets

U.S. PATENT DOCUMENTS

| | | | |
|---|---|---|---|
| 1,826,004 | A | 10/1931 | Key |
| 1,865,127 | A | 6/1932 | McKeen |
| 1,877,016 | A | 9/1932 | Munson |
| 1,993,979 | A | 3/1935 | Reed |
| 2,017,585 | A | 10/1935 | Casey |
| 2,085,732 | A | 7/1937 | Baxter et al. |
| 2,108,475 | A | 2/1938 | Cooper |
| 2,158,915 | A | 5/1939 | Searcy |
| 2,209,524 | A | 7/1940 | Key |
| 2,236,736 | A | 4/1941 | Scott |
| 2,314,061 | A | 3/1943 | Whaley |
| 2,336,718 | A | 12/1943 | Davis |
| 2,385,649 | A | 9/1945 | Prideaux |
| 2,450,584 | A | 10/1948 | Dodge |
| 2,529,057 | A | 11/1950 | Teffault |
| 2,546,242 | A | 3/1951 | Stinson |
| 2,597,565 | A | 5/1952 | Chandler et al. |
| 2,645,017 | A | 7/1953 | Haase |
| 2,657,303 | A | 10/1953 | Dickens |
| 2,844,710 | A | 7/1958 | Zinsser |
| 2,912,566 | A | 11/1959 | Cornett |
| 3,010,019 | A | 11/1961 | Sohst |
| 3,019,542 | A | 2/1962 | Manthos |
| 3,153,856 | A | 10/1964 | Felix |
| 3,222,022 | A | 12/1965 | Akin, Jr. |
| 3,222,511 | A | 12/1965 | Breeding |
| 3,243,896 | A | 4/1966 | Immarco et al. |
| 3,417,237 | A | 12/1968 | Fenton |
| 3,447,033 | A | 5/1969 | Redmond et al. |
| 3,454,898 | A | 7/1969 | Comstock |
| 3,509,344 | A | 4/1970 | Bouwers |
| 3,513,581 | A | 5/1970 | Slater |
| 3,562,944 | A | 2/1971 | Wagner et al. |
| 3,633,285 | A | 1/1972 | Sensney |
| 3,656,845 | A | 4/1972 | Koch-Bossard et al. |
| 3,739,167 | A | 6/1973 | Avery |
| 3,742,636 | A | 7/1973 | Dealy et al. |
| 3,782,832 | A | 1/1974 | Hacskaylo |
| 3,787,693 | A | 1/1974 | Stone |
| 3,834,052 | A | 9/1974 | Steck, III |
| 3,867,764 | A | 2/1975 | Dunmire et al. |
| 3,877,166 | A | 4/1975 | Ward |
| 3,898,747 | A | 8/1975 | Marshall |
| 3,938,262 | A | 2/1976 | Dye et al. |
| 3,974,585 | A | 8/1976 | Dunham |
| 3,995,376 | A | 12/1976 | Kimble et al. |
| 4,000,403 | A | 12/1976 | Rice |
| 4,026,054 | A | 5/1977 | Snyder |
| 4,027,159 | A | 5/1977 | Bishop |
| 4,044,486 | A | 8/1977 | Van Holten |
| 4,069,414 | A | 1/1978 | Bell |
| 4,079,534 | A | 3/1978 | Snyder |
| 4,112,300 | A | 9/1978 | Hall, Jr. et al. |
| 4,152,754 | A | 5/1979 | deFilippis et al. |
| 4,161,076 | A | 7/1979 | Snyder |
| 4,168,588 | A | 9/1979 | Snyder |
| 4,212,109 | A | 7/1980 | Snyder |
| 4,266,873 | A | 5/1981 | Hacskaylo et al. |
| 4,281,993 | A | 8/1981 | Shaw |
| 4,291,479 | A | 9/1981 | Lough |
| 4,295,289 | A | 10/1981 | Snyder |
| 4,310,980 | A | 1/1982 | Pilkington |
| 4,313,272 | A | 2/1982 | Matthews |
| 4,313,273 | A | 2/1982 | Matthews et al. |
| 4,315,150 | A | 2/1982 | Darringer et al. |
| 4,383,371 | A | 5/1983 | Coffey |
| 4,417,814 | A | 11/1983 | Doliber |
| 4,418,487 | A | 12/1983 | Strahan |
| 4,446,644 | A | 5/1984 | Jimenez et al. |
| 4,542,447 | A | 9/1985 | Quakenbush |
| 4,554,744 | A | 11/1985 | Huckenbeck |
| 4,561,775 | A | 12/1985 | Patrick et al. |
| 4,571,870 | A | 2/1986 | Heideman et al. |
| 4,580,362 | A | 4/1986 | Stevens |
| 4,627,183 | A | 12/1986 | Stuckman |
| 4,658,139 | A | 4/1987 | Brennan et al. |
| 4,665,622 | A | 5/1987 | Idan |
| 4,697,226 | A | 9/1987 | Verdin |
| 4,707,595 | A | 11/1987 | Meyers |
| 4,738,044 | A | 4/1988 | Osterhout |
| 4,777,754 | A | 10/1988 | Reynolds, Jr. |
| 4,779,370 | A | 10/1988 | Cormack |
| 4,799,325 | A | 1/1989 | Booze |
| 4,825,744 | A | 5/1989 | Glock |
| 4,853,529 | A | 8/1989 | Meyers |
| 4,856,218 | A | 8/1989 | Reynolds, Jr. |
| 4,876,815 | A | 10/1989 | Terrill |
| 4,876,816 | A | 10/1989 | Triplett |
| 4,893,546 | A | 1/1990 | Glock |
| 4,894,941 | A | 1/1990 | Karow, Jr. |
| 4,905,396 | A | 3/1990 | Bechtel |
| 4,916,579 | A | 4/1990 | Simms |
| 4,916,713 | A | 4/1990 | Gerber |
| 4,926,576 | A | 5/1990 | Maes et al. |
| 4,934,085 | A | 6/1990 | Lough |
| 4,939,863 | A | 7/1990 | Alexander et al. |
| 4,991,183 | A | 2/1991 | Meyers |
| 4,993,833 | A | 2/1991 | Lorey et al. |
| RE33,572 | E | 4/1991 | Meyers |
| 5,026,158 | A | 6/1991 | Golubic |
| 5,031,349 | A | 7/1991 | Vogel |
| 5,036,517 | A | 7/1991 | Meyers |
| 5,040,322 | A | 8/1991 | Iturrey, Jr. |
| 5,040,885 | A | 8/1991 | Simms |
| 5,042,048 | A | 8/1991 | Meyer |
| 5,052,801 | A | 10/1991 | Downes, Jr. et al. |
| 5,056,097 | A | 10/1991 | Meyers |
| 5,058,900 | A | 10/1991 | Denen |
| 5,064,988 | A | 11/1991 | E'nama et al. |
| 5,090,805 | A | 2/1992 | Stawarz |
| 5,107,612 | A | 4/1992 | Bechtel |
| 5,111,587 | A | 5/1992 | Plank |
| 5,118,186 | A | 6/1992 | Schratzenstaller et al. |
| 5,205,044 | A | 4/1993 | DePaoli |
| 5,221,956 | A | 6/1993 | Patterson et al. |
| 5,249,501 | A | 10/1993 | Waldman et al. |
| 5,272,514 | A | 12/1993 | Dor |
| 5,299,375 | A | 4/1994 | Thummel et al. |
| 5,309,337 | A | 5/1994 | Groben |
| 5,355,608 | A | 10/1994 | Teetzel |
| 5,358,135 | A | 10/1994 | Robbins et al. |
| 5,374,986 | A | 12/1994 | Solinsky |
| 5,400,540 | A | 3/1995 | Solinsky et al. |
| 5,425,299 | A | 6/1995 | Teetzel |
| 5,426,880 | A | 6/1995 | Ruger et al. |
| 5,430,967 | A | 7/1995 | Woodman, III et al. |
| 5,471,777 | A | 12/1995 | McDonald |
| 5,481,819 | A | 1/1996 | Teetzel |
| 5,526,749 | A | 6/1996 | Teetzel |
| 5,555,662 | A | 9/1996 | Teetzel |
| 5,581,898 | A | 12/1996 | Thummel |
| 5,584,137 | A | 12/1996 | Teetzel |
| 5,642,932 | A | 7/1997 | Matthews |
| 5,654,594 | A | 8/1997 | Bjornsen, III et al. |
| 5,669,174 | A | 9/1997 | Teetzel |
| 5,685,105 | A | 11/1997 | Teetzel |
| 5,758,448 | A | 6/1998 | Thummel |
| 5,816,683 | A | 10/1998 | Christiansen |
| 5,849,007 | A | 12/1998 | Furhberg et al. |
| 6,112,962 | A | 9/2000 | Matthews |
| 6,185,854 | B1 | 2/2001 | Solinsky et al. |
| 6,190,025 | B1 | 2/2001 | Solinsky |
| 6,222,138 | B1 | 4/2001 | Matthews et al. |
| 6,276,088 | B1 | 8/2001 | Matthews et al. |

| | | | | |
|---|---|---|---|---|
| 6,363,648 | B1 | 4/2002 | Kranich et al. | |
| 6,378,237 | B1 | 4/2002 | Matthews et al. | |
| 6,508,027 | B1 | 1/2003 | Kim | |
| 6,574,901 | B1 | 6/2003 | Solinsky et al. | |
| 6,606,813 | B1 | 8/2003 | Squire et al. | |
| 6,622,416 | B2 | 9/2003 | Kim | |
| 6,629,381 | B1 | 10/2003 | Keng | |
| 6,646,211 | B2 | 11/2003 | Taniuchi et al. | |
| 6,655,069 | B2 | 12/2003 | Kim | |
| 6,851,214 | B2 | 2/2005 | Oz | |
| 7,117,624 | B2 * | 10/2006 | Kim | 42/85 |
| 2001/0022044 | A1 | 9/2001 | Spinner | |
| 2003/0101632 | A1 | 6/2003 | Davenport et al. | |

FOREIGN PATENT DOCUMENTS

| | | | |
|---|---|---|---|
| CH | 217521 | | 10/1941 |
| DE | 1101223 | | 9/1959 |
| EP | 0 335 281 | A2 | 10/1989 |
| FR | 2 592 149 | A1 | 6/1987 |
| GB | 13444 | | 0/1885 |
| GB | 818524 | | 8/1959 |
| GB | 2 052 025 | A | 1/1981 |

OTHER PUBLICATIONS

United States Department of Defense, Military Standard: Dimensioning of Accessory Mounting Rail for Small Arms Weapons, MIL-STD-1913, Feb. 3, 1995.

Glock Inc., Glock Perfection Instructions for Use, Aug. 1999.

Insight Technology Incorporated, M3 Tactical Illuminator Operator Manual, date prior to Apr. 2003.

Surefire, LLC, 2002 Surefire Weaponlight Catalog (including pp. 8-12 and 52), date 2002.

* cited by examiner

ACCESSORY DEVICES FOR FIREARMS

CROSS REFERENCE TO RELATED APPLICATION

This application is a continuation of U.S. patent application Ser. No. 10/819,535, filed Apr. 6, 2004, now U.S. Pat. No. 7,117,624 incorporated in full herein by reference.

BACKGROUND OF THE INVENTION

This invention relates to accessory devices for being mounted to a firearm, and more particularly to a light beam generator for being mounted to a firearm including a handgun.

Accessory devices including light beam generators, such as flashlights and laser aiming devices, have long been adapted for being secured to firearms as target illuminators and laser sights. As particularly relating to handguns, such accessory devices may utilize a longitudinal rail carried by the frame of the handgun and forwardly of the trigger guard, which rail may be integral with the frame as disclosed in U.S. Pat. No. 6,276,088, or such rail may be provided as a separate structure removably attachable to the handgun as disclosed in U.S. Pat. No. 6,378,237, both patents issued to John W. Matthews and Paul Y. Kim and assigned to the assignee of the present invention, which patents are incorporated herein by reference.

Handgun manufacturers have introduced various handgun models having a longitudinal rail along the handgun's frame, below the barrel and forwardly of the trigger guard, such rail being configured with two longitudinal grooves, one along each side of the rail, and further configured with a transverse slot in the bottom surface of the rail. As is well known, such rails are intended for cooperating with accessories such as a light beam generator having a housing configured with a pair of longitudinal tongues complementing the longitudinal grooves for slidably retaining the light beam generator on the rail. A latch on the light beam generator housing co-acts with the transverse slot in the rail for releasably preventing further longitudinal movement of the light beam generator along the rail when the light beam generator is at a predetermined longitudinal position.

The longitudinal rails of handguns of some manufacturers may be of different configuration than the longitudinal rails of handguns of other manufacturers. For example, some handguns include a longitudinal rail commonly known as a Universal rail, while other handguns include a rail commonly known as a Picatinny rail. The slot width of the Universal rail is substantially less than the slot width of the Picatinny rail. Until the present invention, an accessory device securable to one type of rail was not securable to another type of rail.

SUMMARY OF THE INVENTION

The present invention provides an accessory device that is adapted to accommodate handguns and other firearms carrying longitudinal rails of different configurations. For example, the accessory device of the present invention may be secured to a longitudinal rail carried by a firearm having a slot width different than the slot width of another longitudinal rail carried by a firearm. In a particular example, the accessory device of the present invention accommodates a Universal rail as well as a Picatinny rail.

A preferred embodiment of the accessory device of the present invention comprises a light beam generator, such as a target illuminator or a laser sight, that includes a removably attachable switch device for being replaced by or interchanged with another switch device having a different or modified switch configuration.

According to one aspect of the present invention, there is provided an accessory device for a firearm including a frame, a longitudinal barrel, a longitudinal rail carried by the frame, and a depression in the rail, the accessory device comprising: a housing; elongate members removably secured to the housing, the elongate members complementing the rail for enabling the housing to be retainably slid along the rail; and a plate pivotally secured to the housing about a transverse axis and having a free end biased away from the housing, the plate including a protuberance in the vicinity of the free end, the protuberance receivable by the depression for stopping sliding of the housing along the rail. The plate is captured to the housing by the elongate members secured to the housing, and the plate is removable from its securement about the transverse axis when the elongate members are removed from the housing.

The plate preferably includes transversely extending arms through the housing, which arms are captured to the housing by the elongate members when secured to the housing, and the arms are adapted to be urged by an operator for pivoting the plate about the transverse axis toward the housing.

In a preferred embodiment, the accessory device is a light beam generator comprising: a housing; elongate members removably secured to the housing, the elongate members complementing the rail for enabling the housing to be retainably slid along the rail; a plate pivotally secured to the housing about a transverse axis and having a free end biased away from the housing, the plate including a protuberance in the vicinity of the free end, the plate receivable by the depression for stopping sliding of the housing along the rail; a light emitter assembly carried by the housing; a battery carried by the housing in circuit for energizing the light emitter assembly when switch actuated; and a switch device including a switch actuator for the battery. The switch device preferably comprises a tail cap switch pivotally secured to the housing about a pivot axis, the tail cap switch preferably removable from its pivotal securement. The switch actuator is preferably operable by either hand of an operator when the housing is installed on the rail for placing the switch device in a CONSTANT ON or OFF position, and operable by either hand of the operator when the housing is installed on the rail for placing the switch device in a MOMENTARY ON position. A remote switch actuator may be provided for communicating with the switch device for remotely actuating the switch device to a MOMENTARY ON position.

According to a further aspect of the present invention, a method is provided of assembling an accessory device for installation on a first rail having a depression and carried by a firearm, comprising: providing the accessory device including a housing; providing elongate members complementing the rail; providing a plate having a protuberance in the vicinity of an end thereof, the protuberance sized for being received by the depression; pivotally securing the plate to the housing with such end biased away from the housing; and removably securing the elongate members to the housing with the elongate members capturing the plate to the housing and enabling the housing to be retainably slid along the rail. The method may further include: removing the elongate members from the housing; removing the plate from the housing; providing a second plate having a protuberance in the vicinity of an end thereof, the protuberance of the second plate sized for being received by a depression in a second rail carried by a firearm, the protuberance of the second plate being of a different size than the protuberance in the first plate; pivotally securing the second plate to the housing with such second plate end biased away from the housing; and removably securing the elongate members to the housing with the elongate members capturing the second plate to the housing and enabling the housing to be retainably slid along the second rail.

According to yet another aspect of the present invention, there is provided a method of adapting an accessory device normally installable on a first rail carried by a firearm and having a depression, for installation on a second rail carried by a firearm and having a depression of a different size than the depression of the first rail, comprising: providing the accessory device including a housing, a first plate having a protuberance in the vicinity of an end thereof, the protuberance of the first plate sized for being received by the depression in the first rail, the plate being removably pivotally secured to the housing along a transverse axis with such end thereof biased away from the housing, and elongate members complementing the first rail and removably secured to the housing and capturing the plate to the housing, the elongate members enabling the housing to be retainably slid along the first rail; removing the elongate members from the housing; removing the first plate from the housing; providing a second plate having a protuberance in the vicinity of an end thereof sized for being received by the depression in the second rail; removably pivotally securing the second plate to the housing along a transverse axis with such end of the second plate biased away from the housing; and removably securing elongate members complementing the second rail to the housing and capturing the second plate to the housing and enabling the housing to be retainably slid along the second rail. In the elongate members securing step, the elongate members being secured may be the same elongate members removed in the elongate members removing step.

BRIEF DESCRIPTION OF THE DRAWINGS

The novel features believed to be characteristic of the present invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
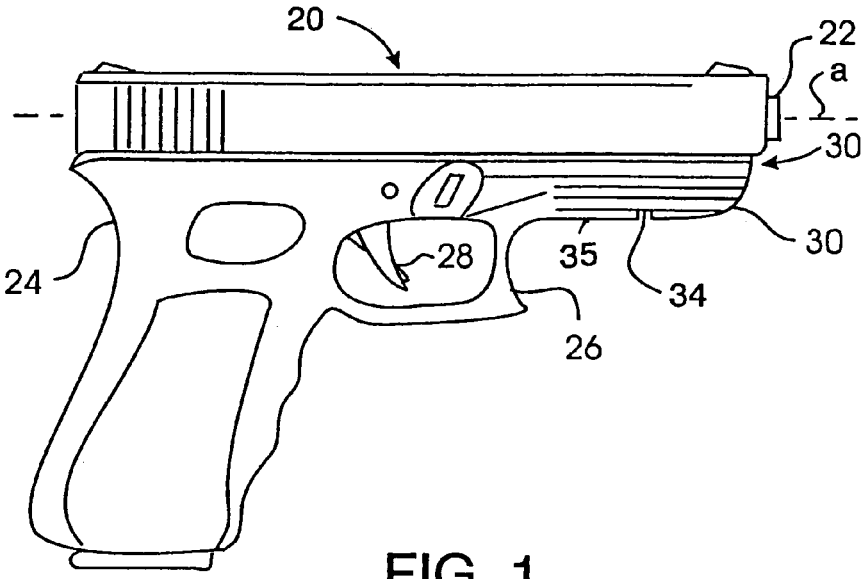
FIG. 1 is a side elevation view of a firearm having a longitudinal rail structure to which may be removably secured an accessory device according to the present invention.

Turning first to FIG. 1, there is illustrated an example of a firearm 20, specifically a handgun including a barrel 22 extending along a longitudinal axis a from the handgun's frame 24. The handgun 20 includes a trigger guard 26 in front of the handgun's trigger 28.

Figure 4:
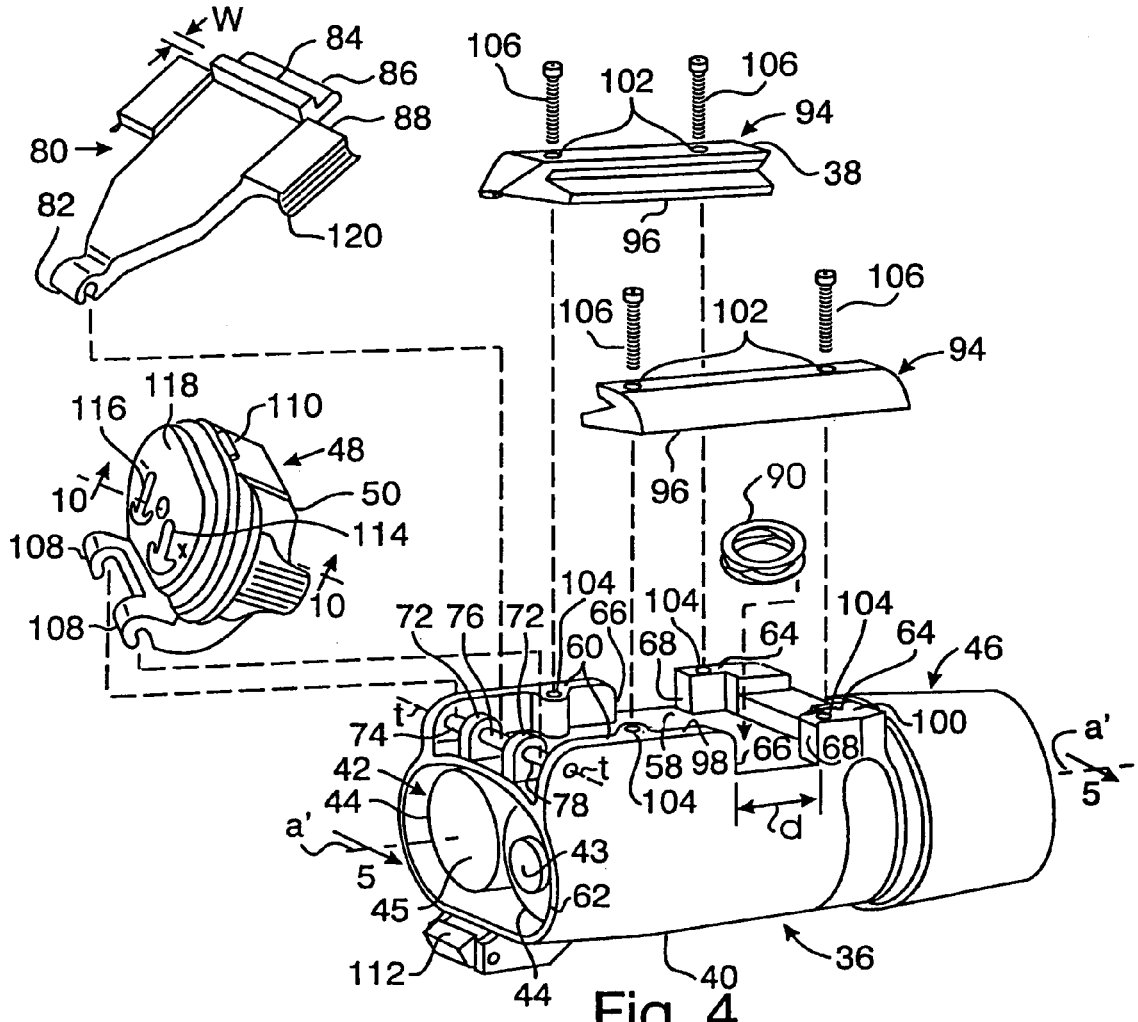
FIG. 4 is an exploded side/rear perspective view of the light beam generator of FIGS. 2 and 3, illustrated during assembly of various components thereof.
Figure 5:
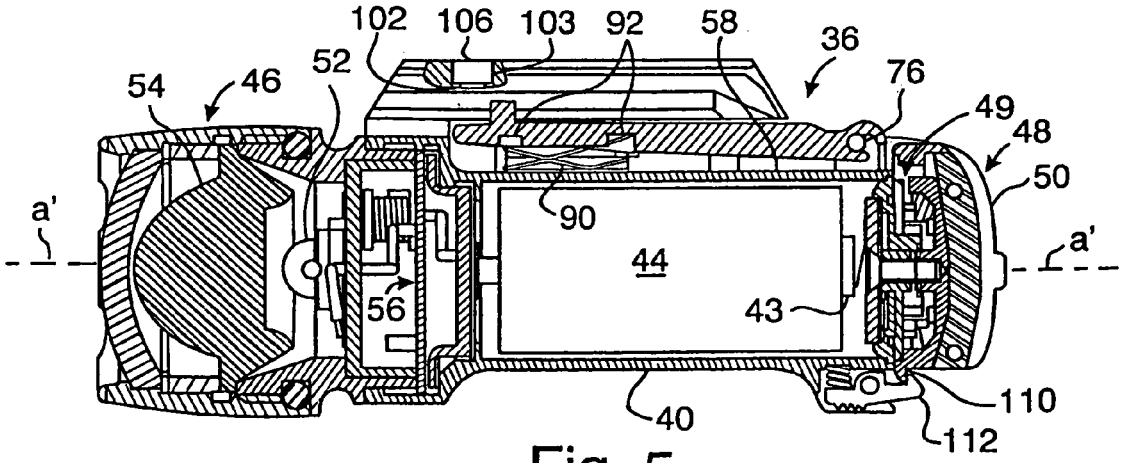
FIG. 5 is a longitudinal cross-sectional view of the assembled light beam generator of FIG. 4 (in further increased scale), taken along a vertical plane along the light beam generator's longitudinal axis a' (the line 5-5 of FIG. 4) and viewed in the direction of the appended arrows.

As used herein, "longitudinal" describes a direction along or parallel to the longitudinal axis a of the firearm's barrel, or along or parallel to the longitudinal axis a' of the light beam generator 36 (see also FIGS. 2, 4 and 5) which is parallel to the axis a when the light beam generator 36 is installed on the firearm; "transverse" describes a horizontal direction perpendicular to the axis a (or axis a') when the barrel 22 (or light beam generator 36) is horizontally positioned; "above" means vertically above and "upward" means vertically upward when the firearm barrel 22 (or light beam generator 36) is horizontally positioned; "below" or "beneath" means vertically below and "downward" means vertically downward when the firearm barrel 22 (or light beam generator 36) is horizontally positioned; "front" or "forward" describes the longitudinal direction toward the muzzle of the barrel 22 or the light emitter assembly 46 (i.e., to the right as shown in FIGS. 1, 2 and 4, and to the left as shown in FIG. 5); and "rear" or "rearward" describes the longitudinal direction opposite the front or forward direction (i.e., to the left as shown in FIGS. 1, 2 and 4, and to the right as shown in FIG. 5).

Figure 3:
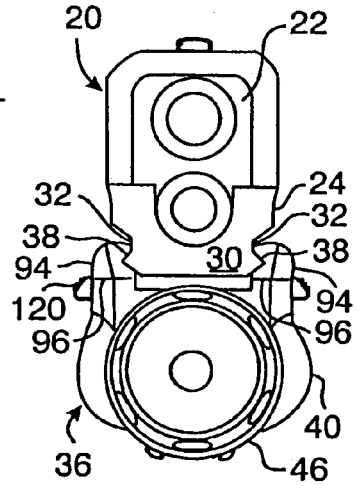
FIG. 3 is a front elevation view of the firearm and secured light beam generator of FIG. 2.

The handgun 20 includes a longitudinal rail 30 along the frame 24, below the barrel 22 and forwardly of the trigger guard 26. Such rails are well known in the handgun art, for mounting accessories thereto such as a light beam generator. The rail 30 is configured with two longitudinal grooves 32, one along each side of the rail 30, and is further configured with a transverse slot 34 in the bottom surface of the rail 30. As is well known, such rails are intended for cooperating with accessories such as a light beam generator having a housing configured with a pair of longitudinal tongues (in this respect, see the tongues 38 of the preferred light beam generator 36 of the present invention as represented in FIG. 3), with such tongues 38 complementing the longitudinal grooves 32 for slidably retaining such light beam generator on the rail 30. A latch on the light beam generator housing co-acts with the transverse slot 34 in the rail 30 for releasably preventing further longitudinal movement of the light beam generator along the rail 30 when the light beam generator is at a predetermined position along the rail 30.

Although the rail 30 is represented in FIG. 1 as being integral with the frame 24 of the handgun 20, the rail 30 may also be provided as a separate structure that may be removably attached to the handgun beneath the barrel and forwardly of the trigger guard. As previously noted, such rails for handguns, both integral to the frame and removably attachable to the handgun, as well as light beam generators adapted for being removably attached to such rails as discussed above, are disclosed in the aforementioned U.S. Pat. Nos. 6,276,088 and 6,378,237 incorporated herein by reference.

Figure 2:
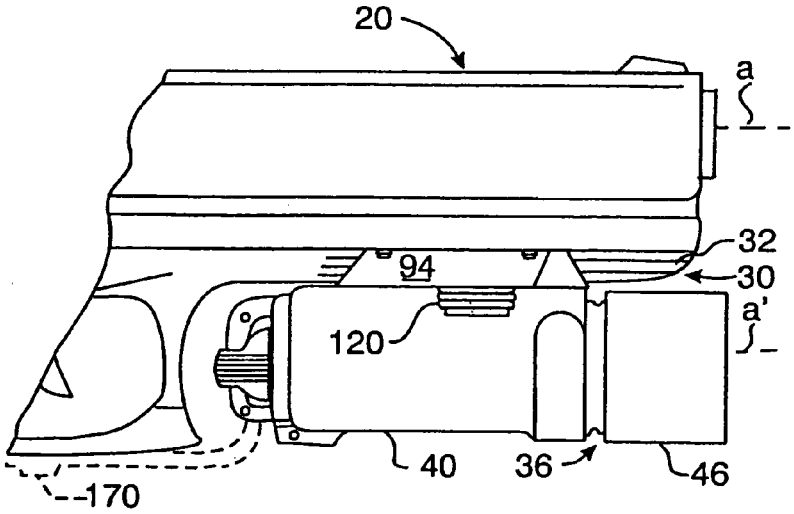
FIG. 2 is a side elevation view of a preferred embodiment of an accessory device according to the present invention, specifically a preferred embodiment of a light beam generator, removably secured to the rail structure of the firearm of FIG. 1 (in increased scale)

Handgun manufacturers have introduced various handgun models with integral rails having longitudinal grooves of the type shown in FIGS. 1-3. Although such longitudinal grooves among manufacturers have been of substantially similar dimensions, the transverse slots in the rails of handguns of some manufacturers are of different width than the transverse slot in the rails of handguns of other manufacturers. Specifically, the rails of some handguns include a transverse slot of one predetermined width while the rails of other handguns include a transverse slot of another predetermined width. For example, some handguns include a rail commonly known as a Universal rail, while other handguns include a rail commonly known as a Picatinny rail; the slot width of the Universal rail is substantially less than the slot width of the Picatinny rail. The accessory device or light beam generator 36 of the present invention accommodates both types of rails.

The light beam generator 36 further includes a removably attachable switch device, for being replaced by or interchanged with another switch device having a different or modified switch configuration.

Turning also to FIGS. 4-8, the light beam generator 36 includes a housing 40 in which is contained a power source such as a battery 42 of one or more battery cells 44 (for example, two 3-volt lithium battery cells 44). A light emitter assembly 46 is carried by the housing 40 forwardly of the battery 42 and in circuit with a positive front terminal of one of the battery cells 44 and a negative front terminal of another of the battery cells 44. A switch device 48 preferably situated at the rear of the housing 40 in and including a tail cap 50, includes a switch actuator assembly 49 for selectively completing and opening the light emitter energization circuit. In the embodiment shown, this is accomplished by the switch actuator assembly 49 establishing a conductive path between the rear positive terminal 43 of one of the battery cells 44 and the rear negative terminal 45 of the other of the battery cells 44 for placing the switch device 48 in an ON position for causing the battery 42 to energize the light emitter assembly 46, and by opening such conductive path for placing the switch in an OFF position where the battery 42 does not energize the light emitter assembly 46.

As shown in FIG. 5, a preferred light emitter assembly 46 may include a light emitter 52 such as a light emitting diode (LED), preferably a high luminous flux LED such as a 3-watt or 5-watt LED manufactured by Lumileds Lighting, LLC (of San Jose, Calif.) and marketed under the trademark LUXEON including such LEDs marketed under the LUXEON STAR trademark.

With such an LED as the light emitter 52, the emitted light may be directed by a lens system contained in the light emitter assembly 46 including a totally internal reflective (TIR) lens 54 (as represented in FIG. 5), or by a parabolic reflector system as disclosed in U.S. patent application Ser. No. 10/346,537 of Paul Y. Kim and William A. Hunt, assigned to the assignee of the present invention, which patent application is incorporated herein by reference. The light emitter assembly 46 may alternatively include an incandescent lamp as the light emitter 52, such as a high intensity tungsten light bulb, with the emitted light preferably directed by a parabolic reflector.

In either case, the light emitter assembly 46 may further include a controller 56 for regulating the power to the light emitter for providing light output of constant brightness with decreasing battery voltage over time. The use of such controllers is discussed in the aforesaid patent application Ser. No. 10/346,537 incorporated herein by reference.

The preferred embodiment of the housing 40 of the light beam generator 36 of the present invention includes a substantially flat upwardly facing surface 58 with two upstanding first wall segments 60 longitudinally extending forwardly along opposite sides of the surface 58 from the vicinity of the housing's rear end 62, and two upstanding second wall segments 64 forwardly of the respective first wall segments 60. The forward generally vertical ends 66 of the respective first wall segments are transversely aligned, and the rear generally vertical ends 68 of the respective second wall segments 64 are transversely aligned and spaced from the second wall segments' forward ends 68 by a predetermined distance d.

A transversely disposed pin 70 is secured to the housing 40 in the vicinity of its rear end 62 and above the housing's flat surface 58. As shown in FIG. 4, the transverse pin 70 is secured to the first wall segments 60 in the vicinity of their rear ends and above the flat surface 58. The pin 70 additionally extends through apertures in two upstanding protuberances or partitions 72 from the flat surface 58. The two partitions 72 are laterally spaced so as to divide the transverse pin into three exposed segments 74, 76, 78 which may be of substantially equal lengths.

The light beam generator 36 includes a latch lever plate 80 having a generally U-shaped rear end 82 configured for receiving the middle segment 76 of the transverse pin 70. One leg (preferably the upper leg 83) of the U may curve over a portion of the generally rearwardly facing opening of the U, and the plate 80 is preferably made of a material such that the legs are somewhat resilient. As illustrated in FIG. 4, the latch plate 80 is installed to the housing 36 by placing the opening of the latch plate's rear end 82 to the transverse pin segment 76, and the installer urging the rear end 82 to snap onto the pin segment 76. The latch plate 80 accordingly is hinged at its rear end 82 about the transverse hinge pin 70, specifically about the hinge pin segment 76; i.e., the plate 80 is pivotally secured to the housing 40 about a transverse axis t along the pin 70.

The top surface of the plate 80 includes an upstanding protuberance, preferably a transversely disposed elongate protuberance 84, in the vicinity of the plate's front end 86, the elongate projection 84 having a width w (along the longitudinal direction) slightly less than the slot 34 of the firearm's rail 30 for being received therein. Lateral arms 88 transversely extend outwardly from opposite sides of the plate 80, the arms 88 situated in the vicinity of the plate's front end 86 and being of a width d' (along the longitudinal direction) slightly less the distance d between the forward ends 66 of the first wall segments 60 and the respective rear ends 68 of the second wall segments 64 (see FIG. 4) such that the arms 88 are received between such ends 66 and 68. The vertical height of the end portions 66 and 68 is preferably greater than the sum of the vertical thickness of the plate 80 and the vertical height of the protuberance 84.

During installation of the plate 80 to the housing 40, after being hinged to the hinge pin segment 76 the plate 80 is pivoted toward the housing's upwardly facing surface 58 (i.e., in the clockwise direction as viewed in FIG. 4) with a wave spring 90 held by an annular groove 92 in the underside of the plate 80 (see also FIGS. 5 and 7) in the longitudinal vicinity of the protuberance 84 and the lateral arms 88, until the spring 90 contacts the flat upwardly facing surface 58 of the housing 40 while the lateral arms 88 of the plate 80 are caused to enter the space between the wall surfaces 66 and 68.

The accessory device or light beam generator 36 includes two elongate members 94 removably secured to the housing 40, for interfacing with the firearm rail 30 to enable the housing 40 to be retainably slid along the rail 30 (see, in particular, FIGS. 1, 2, 3 and 5). Each elongate member 94 includes an inwardly directed tongue 38 longitudinally extending along such member 94; i.e., such elongate rail interface members 94 are installed to the housing 40 with the longitudinal tongue 38 of one of the members 94 facing the longitudinal tongue 38 of the other of the members 94, the tongues 38 complementing the firearm's longitudinal grooves 32 for slidably cooperating with the firearm's longitudinal grooves 32 while being vertically retained by the rail 30 as shown in FIGS. 2 and 3.

The elongate rail interface members 94 are installed to the housing 40 after the latch plate 80 has been hinged to the hinge pin segment 76 and pivoted with its lateral arms 88 in the space between the upstanding wall segment ends 66 and 68 as discussed above. Each member 94 includes a flat bottom surface 96 for contacting the top surfaces 98 and 100 of the housing's respective wall segments 60 and 64. The members 94 include bores 102 therethrough aligned with internally threaded blind vertical bores 104 in the top surfaces 98, 100 of the housing's wall segments 60, 64, preferably forwardly of the wall segment ends 68 and rearwardly of the wall segment ends 66, the members 94 being removably secured to the wall segments 60, 64 by headed screws 106 respectively extending into the bores 102 through the member 94 and threaded into the respectively aligned threaded bores 104 in the housing 40. With the elongate members 94 so installed, their bottom surfaces 96—which contact and extend along the top surfaces 98, 100 of the wall segments 60, 64—bridge the wall segments 60, 64 and provide a ceiling to the space between the wall ends 66, 68. Such bridge or ceiling upwardly captures the lateral arms 88 within such space, while the wall ends 66, 68 longitudinally captures the lateral arms 88 within such space, resulting in the hinged latch plate 80 being captured to the housing 40 as well.

The elongate rail interface members 94 may be removed from the housing 40 by unscrewing the screws 106, and if desired the elongate rail interface members 94 may be replaced by other or different elongate rail interface members which are similarly removably securable to the housing 40. It may be appreciated that when the rail interface members 94 have been removed from the housing 40, the lateral arms 88 of the hinged latch plate 80 are no longer upwardly blocked or captured by the members 94, so that the latch plate 80 may be pivoted about the hinge pin 70 away from the surface 58 of the housing 40 and pulled away from the hinge pin segment 76. In such manner, the latch plate 80 may be removed from the housing 40 and another or different latch plate 80, which is similarly removably securable to the housing 40, may be hinged to the hinge pin 70 and upwardly captured by reinstalling the rail interface members 94.

Another feature of the preferred embodiment of the light beam generator 36 of the present invention comprises the tail cap switch device 48 which functions both as a battery cover permitting the battery cells 44 to be installed and retained in the housing 40 and as a switch for actuating the battery 42 to selectively energize the light emitter of the light emitter assembly 46. The preferred embodiment of the tail cap switch 48 is removably securable to the rear end 62 of the housing 40.

The switch device 48 includes a tail cap 50 which is hinged to the transverse hinge pin 70 by two transversely spaced-apart forward projections 108 each having a generally U-shaped end portion, one leg of the U preferably curving over a portion of the generally upwardly and rearwardly facing opening of the U. The projections 108 are preferably somewhat resilient and, as illustrated in FIG. 4, the switch device 48 is installed to the housing 36 by placing the openings of the cap's projections 108 to the transverse pin outer segments 74 and 78, the installer urging the projections 108 to snap onto the pin segments 74, 78. The tail cap 50 accordingly is hinged about the transverse hinge pin 70, specifically about the hinge pin segments 74, 78; i.e., the tail cap switch is pivotally secured to the housing 40 about a pivot axis, preferably the transverse axis t.

The installer thereupon rotates the tail cap 50 toward the housing's open rear end 62 (i.e., counterclockwise as viewed in FIG. 4) until the rear opening of the housing 40 is closed and the tail cap 50 is locked into place by cooperation of a catch 110 along the lower edge of the tail cap 50 with a spring-biased latch 112 on the housing 40 (FIGS. 4 and 5). When the tail cap 50 is in its latched position, the forwardly facing battery contacts 114, 116 on the switch device circuit board 118 are in conductive contact with the respective rear battery terminals 43, 45.

The switch device 48 may be removed from the housing 40 by manually unlatching the latch 112, pivoting the tail cap 50 upwardly about the hinge pin 70 away from the housing's rear opening (for example, to the position generally illustrated in FIG. 4) and pulling the switch device 48 away from the hinge pin segments 74 and 78. In such manner, the switch device 48 may be removed from the housing 40 and another or different switch device, which is similarly removably securable to the housing 40, may be hinged to the hinge pin 70 and locked to the rear end 62 of the housing 40 by operation of the latch 112.

When the light beam generator 36 is in its assembled condition (i.e., with the tail cap switch 48, latch plate 80 and rail interface members 94 installed to the housing 40 as described above), the assembled light beam generator 36 may be removably installed to the firearm 20. The light beam generator 36 is placed to the firearm 20 with the rear ends of the tongues 38 of the rail interface members 94 respectively engaging the forward ends of the grooves 32 of the rail 30 carried by the firearm 20. The light beam generator 36 is thereupon rearwardly urged, thereby sliding the housing 40 along the rail 30 while the housing 40 is being vertically retained by the rail 30. When the transverse upstanding protuberance 84 of the latch plate 80 contacts the bottom surface of the rail 30 (which may be facilitated by a swept-back profile of the forward portion of the rail 30 illustrated in FIGS. 1 and 2, preferably of a height at least as great as the height of the protuberance 84), the latch plate is thereby urged to pivot about the hinge pin 70 against the bias of the spring 90, until the transverse protuberance 84 enters the transverse slot 34 as the spring 90 urges the plate 80 to pivot about the hinge pin segment 76.

As earlier noted, the width w of the protuberance 84 is slightly less than the width of the slot 34 such that the protuberance 84 just fits into the slot 34. The engagement of the protuberance 84 with the slot 34 stops further longitudinal movement of the housing 40 along the rail 30, longitudinally latching the housing 40 in this position. The longitudinal positions of the slot 34 and of the protuberance 84 are preferably predetermined such that the rear end of the tail cap 50 is situated just forwardly of the handgun's trigger guard 26 when the protuberance 84 engages the slot 34.

Because the dimensional tolerances of rails 30 may differ among firearm manufacturers, and even among firearms manufactured by the same manufacturer, the rail interface members 94 may be configured to accommodate such differences. In a preferred embodiment of the rail interface members 94 for accommodating such differences, the bores 102 and the counterbores 103 in the rail interface members 94 may be slightly greater in at least the transverse direction than the respective diameters of the threaded shaft 107 and head 109 of the screws 106, for providing a loose fit in at least the transverse direction between the screws 106 and the bore 102/counterbore 103 combinations. For example, the diameters of the screw-head 109 and threaded shaft 107 may be slightly greater than the diameters of the counterbore 103 and bore 102, respectively.

During installation of the light beam generator 36 to a particular firearm rail 30, if the engagement of rail interface members 94 to the rail 30 is too loose, the installer may simply loosen the screws 106, move the rail interface members 94 inwardly (transversely toward each other) and thereupon tighten the screws 106 with the screw-heads 109 urged against the peripheral floor annular ledge 105 of the counterbores 103. If the engagement between the rail interface members 94 and the rail 30 is too tight, the installer may loosen the screws 106, move the rail interface members 94 outwardly (transversely away from each other), and tighten the screws 106 with the bottom surface 111 of the screw-heads 109 urged against the peripheral floor or annular ledge 105 of the counterbores 103.

To remove the accessory device 36 from the firearm 20, the operator downwardly urges the laterally protruding handles 120 on the ends of the lateral arms 88, causing the plate 80 to pivot about the hinge pin 70, against the bias of the spring 90, until the protuberance 84 is disengaged from the transverse slot 34. The operator thereupon forwardly urges the accessory device 36 to slide along the rail 30 until the accessory device 36 is removed therefrom.

A preferred embodiment of the tail cap switch device 48 of the present invention permits ambidextrous actuation of the switch device 48 for energizing the light emitter 52 in a CONSTANT ON/OFF mode as well as in a MOMENTARY ON mode. The switch mechanism for implementing such operation is shown in FIGS. 10-17.

A switch actuator arm 122 (e.g. fabricated of stainless steel) is affixed to an actuator disk 124 (e.g. fabricated of a polymeric material) rotatable about a circular protuberance 125 along the longitudinal axis a'. The actuator disk 124 is also rotatable about an elastomeric washer 127 (e.g. fabricated of rubber) rearwardly projecting from the tail cap insert 130 and having a rearwardly facing annular rim 128 adjacent to the forward surface of the actuator disk 124.

The actuator disk 124 is rotatable with the actuator arm 122 about the longitudinal axis a'. The disk 124 includes peripheral notches 126 engaged by ends of a latching spring 129 secured to the tail cap insert 130, for latching the disk 124 and hence the actuator arm 122 in a first rotational position where the arm 122 is transversely oriented (FIG. 14), a second rotational position where the arm 122 is rotated clockwise by a predetermined angle (say, approximately 20°), and a third rotational position where the arm 122 is rotated counterclockwise by a predetermined angle (say, approximately 20°). An operator may selectively rotate the arm into these three alternative latched positions by manipulating up or down either one of the handles 132 attached to the ends of the actuator arm 122.

The tail cap insert 130 includes a plate 134 (preferably of a plastic material such as polypropylene), having two rearwardly projecting nubs 136 at the free ends of flexible fingers 138 formed by cuts 140 through the insert plate 134. The end portions 142 of the actuator arm 122 are situated just to the rear of the rearwardly projecting nubs 136. Angularly extending from each of the actuator arm end portions 142 is a forwardly stepped tab 144. The end portions 142 of the actuator arm 122 are normally situated longitudinally just to the rear of the rearwardly projecting nubs 136 when the actuator arm 122 is in its latched first or transverse position. However, when the actuator arm 122 is in either of its latched second or third rotated positions, one of the forwardly stepped tabs 144 contacts one of the nubs 136 and urges such contacted nub 136 to be forwardly displaced. When the operator rotatably replaces the actuator arm 122 to its latched first or transverse position, the corresponding resilient finger 138 replaces the affected nub 136 to its normal or unactuated position.

When the switch actuator arm 122 is in its latched first rotational or transverse position, the operator may push either of the handles 132 in the forward direction, causing the actuator arm 122 to compress a peripheral portion of the elastomeric rimmed washer 127, rocking the actuator arm 122 so that its pushed end portion 142 is caused to be forwardly displaced. Such end portion 142 contacts and forwardly urges the correspondingly situated nub 136 for such time that the handle 132 is forwardly urged by the operator. When the operator releases the handle 132, the resiliency of the washer 127 replaces the actuator arm 122 end portion 142 to its normal undepressed position thereby permitting the resilient finger 138 of the affected nub 136 to replace such nub 136 in its normal unactuated position.

It may be appreciated that the forward displacement of the actuator arm ends, and their resilient replacement, may be implemented by other mechanisms, for example by increasing the longitudinal elasticity of the actuator arm itself.

The forward face of the insert plate 134 is covered with a non-conductive elastomeric sheet, such as a rubber membrane 146 secured to the plate 134. The tail cap insert 130 is mounted within the tail cap 50 by screw 148, with the rubber membrane 146 obverse and in proximity to the rear face 150 of the tail cap battery terminal circuit board 118 also secured to the tail cap 50 by the screw 148. The respective free end portions 151, 153 of the resilient contacts 152, 154 secured to the tail cap circuit board's rear face 150 are situated directly forwardly of the nubs 136 with the rubber membrane 146 interposed therebetween. When a nub 136 is forwardly displaced, such nub 136 presses (through the interposed rubber membrane 146) the corresponding resilient contact's end portion 151 or 153 into contact engagement with the circuit board's rear face 150.

When the tail cap 50 is installed and latched to the housing 40, the battery contacts 114, 116 secured to the circuit board's forward face 156 are in contact engagement with the respective battery cell terminals 43, 45; i.e., the battery contact 114 is in contact engagement with the positive terminal 43 of one of the battery cells 44, and the battery contact 116 is in contact engagement with the negative terminal 45 of the other of the battery cells 44.

The positive battery contact 114 conductively communicates with a first conductive area 158 (FIG. 11) on the rear surface 150 of the circuit board 118, while the negative battery contact 116 conductively communicates with a second conductive area 160 on the rear face 150 of the circuit board 118 to which the resilient contact 154 is conductively secured. When the free end 153 of resilient contact 154 on the circuit board's rear face 150 is urged into contact engagement with the first conductive area 158, there is established a conductive path between the negative battery terminal contact 116 and the positive battery terminal contact 114 (and hence between the negative and positive battery terminals 45, 43), thereby placing the switch device 48 in an ON position completing the electrical circuit between the battery 42 and the light emitter assembly 46.

The positive battery terminal 114 is conductively secured to a third conductive area 162 (FIG. 11) on the forward face 156 of the circuit board 118, while the resilient contact 152 on the circuit board's rear face 150 (but which is normally electrically isolated from the conductive areas on the circuit board's rear face 150) conductively communicates with the conductive area 162 on the circuit board's forward face 156. When the free end 151 of the resilient contact 152 is urged into contact engagement with the second conductive area 160 on the circuit board's rear face 150, there is established a conductive path between the positive battery terminal contact 114 and the negative battery terminal contact 116 (and hence between the positive and negative battery terminals 43, 45), thereby placing the switch device 48 in an ON position completing the electrical circuit between the battery 42 and the light emitter assembly 46.

The switch device 48 is in an OFF position when the actuator arm 122 is in its normal position, i.e. in its first latched or transverse position and with neither of its end portions 142 forwardly depressed. It may be appreciated that when an operator manually urges either one of the handles 132 either downwardly or upwardly, the actuator arm 122 is rotated into either one of its latched second or third positions thereby placing the switch 48 in a CONSTANT ON position. The switch 48 remains in such CONSTANT ON position until the operator manually urges either one of the actuator arm handles 132 to effect a reverse rotation of the actuator arm 122 for causing the actuator arm 122 to be replaced in its latched first or transverse position, in which position the switch 48 is placed and maintained in its normal OFF position until further actuation by the operator.

It may be appreciated, as well, that the switch 48 may be actuated from an OFF position to a MOMENTARY ON position. When the actuator arm 122 is in its latched first or transverse position, the operator may manually forwardly urge or depress either one of the actuator arm handles 132, placing the switch 48 in its ON position for only as long as the operator continues to depress the handle 132. When the operator releases the handle 132, the switch 48 resumes its normal OFF position.

An important feature of the preferred embodiment of the switch 48 is its ability to be actuated by either hand of the operator, in placing the switch 48 in its CONSTANT ON position and back to its normal OFF position, as well as for placing the switch 48 in its MOMENTARY ON position.

Figure 18:
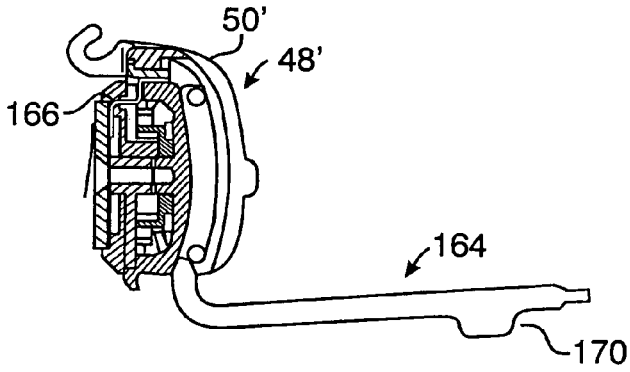
FIG. 18 is a cross-sectional view of a replaceable tail cap switch assembly similar to the tail cap switch assembly shown in FIG. 5 but further including a pressure tape switch.
Figure 19:
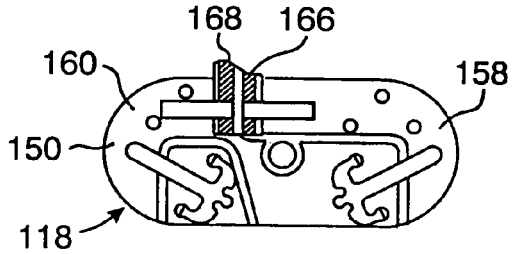
FIG. 19 is a rear view of the switch assembly circuit board of FIG. 18.

A second preferred tail cap switch embodiment 48' is shown in FIGS. 18 and 19. This second embodiment 48' is substantially the same as the first switch embodiment 48 except that, in addition to the CONSTANT ON/OFF and MOMENTARY ON switch operations actuable upon manipulation of either of the handles 132 at the ends of the switch actuator arm 122, the second switch embodiment 48' further includes a MOMENTARY ON remote switching capability provided by a type of switch commonly known as a slimline or tape switch 164. Tape switches are well known in the art, and their construction typically includes spaced electrodes in a flexible enclosure to which pressure may be manually applied by an operator for squeezing the electrodes together thereby bringing them into electrical contact with each other. The electrodes resume their spaced condition when the operator discontinues the application of such pressure. Tape switches used with illumination apparatus removably attachable to handguns are described in U.S. Pat. No. 5,654,594 issued to Bernie E. Bjornsen, III, Peter Hauk and John W. Matthews and assigned to the assignee of the present invention, and in U.S. Pat. No. 6,276,088 issued to John W. Matthews and Paul Y. Kim and assigned to the assignee of the present invention, which patents are incorporated herein by reference.

The tape switch 164 which may be utilized in connection with the second preferred embodiment 48' of the tail cap switch device includes two electrically conductive leads 166, 168 insulated from each other and extending from the tail cap 50' to a pressure sensitive switch actuator 170 remote from the tail cap 50'. The switch actuator 170 may be positioned under the trigger guard 26 (as shown in phantom in FIG. 2), or the switch actuator 170 may be of a type which horseshoes about the handgun grip as shown in the aforementioned U.S. Pat. Nos. 5,654,594 and 6,276,088.

The tail cap-situated ends of the conductive leads 166, 168 are conductively secured to the tail cap circuit board 118 for conductively communicating with the positive and negative battery cell contacts 114, 116. As shown in FIG. 19, the tape switch lead 166 is conductively secured to the first conductive area 158 of the circuit board's rear face 150, which conductive area 158 conductively communicates with the positive battery contact 114 on the circuit board's forward face 156 as previously described. The tape switch lead 168 is conductively secured to the conductive area 160 on the circuit board's rear face 150, which conductive area 160 conductively communicates with the battery cell negative terminal contact 116 on the circuit board's forward face 156 as previously described. Accordingly, when the circuit of the tape switch 164 is closed upon the application of pressure to the tape switch actuator 170, the battery cell positive terminal 43 is conductively connected to the battery cell negative terminal 45 during such time that actuating pressure is continued to be applied to the tape switch actuator 170.

It should be noted that, like the two switching modes of the tail cap switch 48 permitted by the switch actuator arm 122, the remotely situated tape switch actuator 170 (whether situated under the trigger guard or horseshoed about the front of the handgun grip) may be operated with either of the operator's hands and, in addition, the tape switch actuator 170 may be operated by the same hand used for pulling the handgun's trigger.

Figure 6:
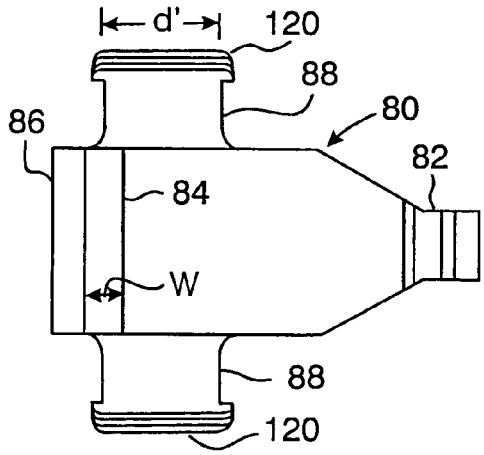
FIG. 6 is a top plan view of a preferred embodiment of a replaceable lever latch plate (in same scale as in FIG. 5) included in the preferred embodiment of the accessory device or light beam generator.
Figure 7:
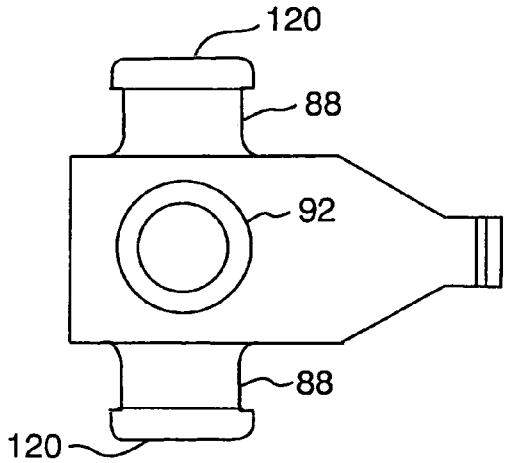
FIG. 7 is a bottom plan view of the lever latch plate of FIG. 6.
Figure 8:
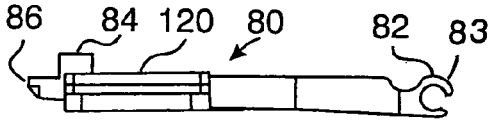
FIG. 8 is a side elevation view of the lever latch plate of FIG. 6.
Figure 9:
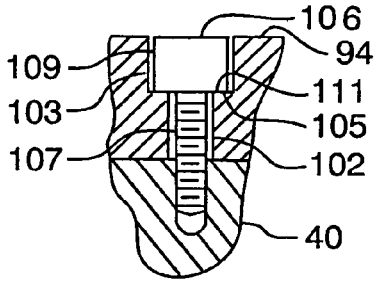
FIG. 9 is a fragmentary, part cross-sectional elevation view of an example of a rail interface member secured to the accessory device housing according to the preferred embodiment.
Figure 10:
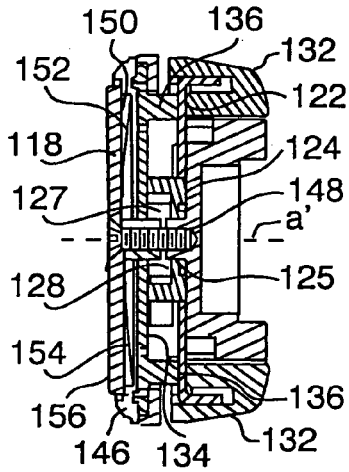
FIG. 10 is a cross-sectional view of the preferred embodiment of a replaceable tail cap switch assembly shown in FIG. 4, taken along a transverse plane along the longitudinal axis a' (the line 10-10 of FIG. 4) and viewed in the direction of the appended arrows.
Figure 11:
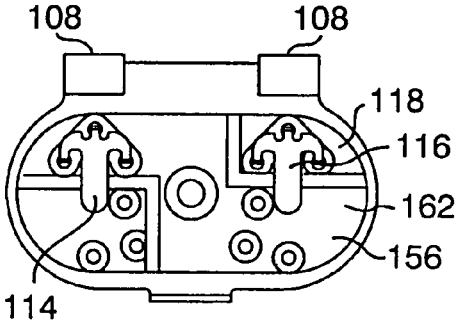
FIG. 11 is a front elevation view of the tail cap switch assembly, which view includes the front surface of the switch circuit board with battery rear terminal contacts.
Figure 12:
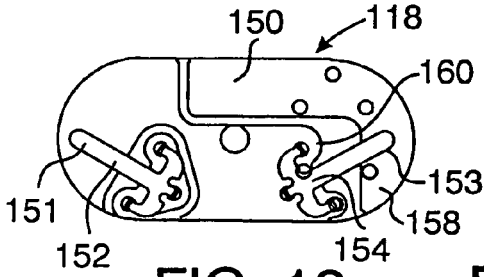
FIG. 12 is a rear view of the tail cap switch assembly circuit board of FIG. 11.
Figure 13:
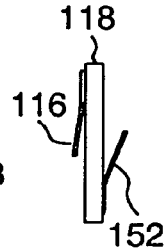
FIG. 13 is a side elevation view of the tail cap switch assembly circuit board of FIGS. 11 and 12.
Figure 14:
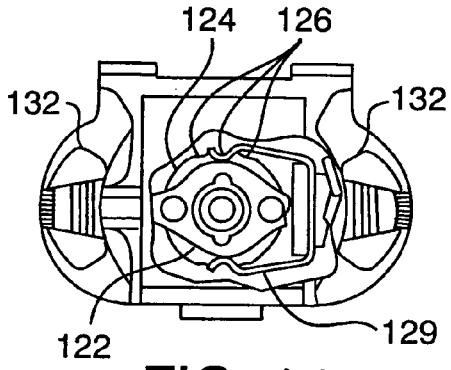
FIG. 14 is a rear elevation view of the tail cap broken away to show structure of a preferred switch actuator mechanism.
Figure 15:
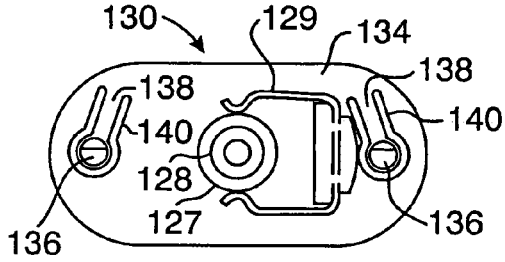
FIG. 15 is a front elevation view of a tail cap insert included in the tail cap switch actuator mechanism.
Figure 16:
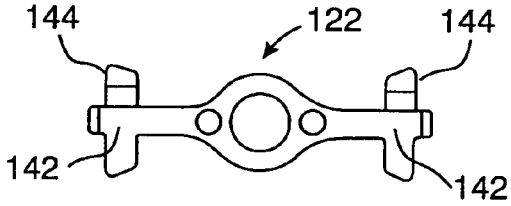
FIG. 16 is a rear elevation view of an actuator arm included in the tail cap switch actuator mechanism.
Figure 17:
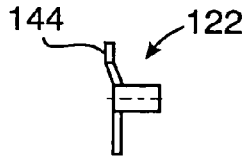
FIG. 17 is a left side view of the actuator arm of FIG. 16.
Figure 20:
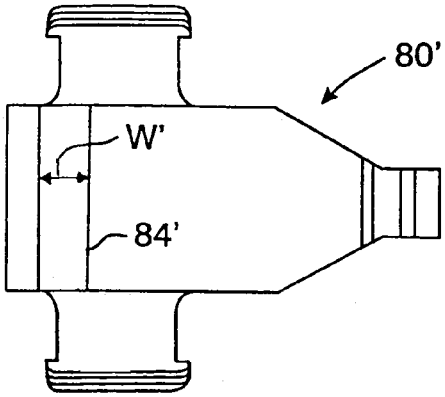
FIG. 20 is a top plan view of a second preferred embodiment of a replaceable lever latch plate included in the preferred embodiment of the accessory device or light beam generator.

It has been noted that the latch plate 80, described in connection with FIG. 6, includes a transversely disposed elongate protuberance 84 having a width w slightly less than the slot 34 of the firearm's rail 30 for being received therein. Different firearm rails may have different slot widths, and indeed two well-known types of rails (namely, a Universal rail and a Picatinny rail) have slots of respectively different standardized widths. In order to accommodate both types of rails, the preferred embodiment of the accessory device 36 of the present invention may be provided with two types of replaceable latch plates. For example, the accessory device 36 may be provided with a latch plate 80 having a protuberance width w of approximately 0.125 inch for accommodating the transverse slot in a Universal rail, while another latch plate 80' (shown in FIG. 20) may be provided having a width w' of its transversely disposed elongate protuberance 84' of approximately 0.205 inch for accommodating the transverse slot of a Picatinny rail. Except for the differences in the width of the transverse protuberance shown as examples of the latch plate 80 and the latch plate 80', the two latch plates 80, 80' are substantially identical and one may be substituted for the other in the accessory device 36 according to the present invention.

Accessory devices according to the present invention, including the preferred embodiment 36 thereof, may be removably secured to firearms other than handguns, as well as to other types of firearms that do not have integral rails but are adapted for having accessory rail mount system devices secured thereto. Such rail mount system devices are well known in the firearms art, and may be of the type 172 (see FIG. 21) comprising a series of longitudinally spaced-apart ribs 174 separated by transverse slots 176, such as a Picatinny rail specified in MIL-STD-1913 incorporated herein by reference.

Figure 21:
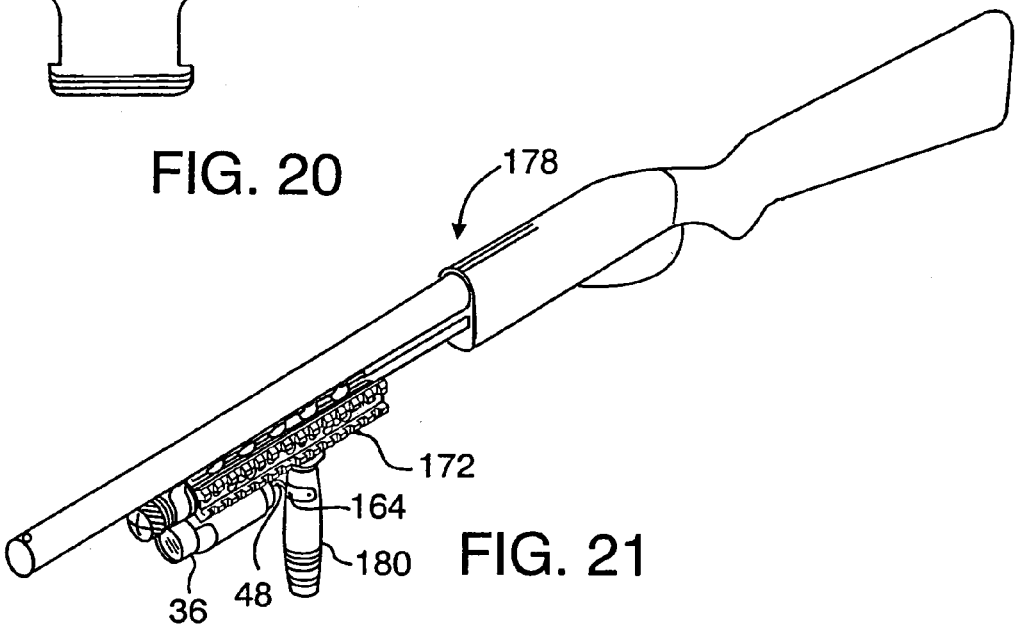
FIG. 21 is a perspective view of a firearm to which is attached a conventional accessory rail mount structure to which is mounted the preferred embodiment of the accessory device or light beam generator of the present invention.
Figure 22:
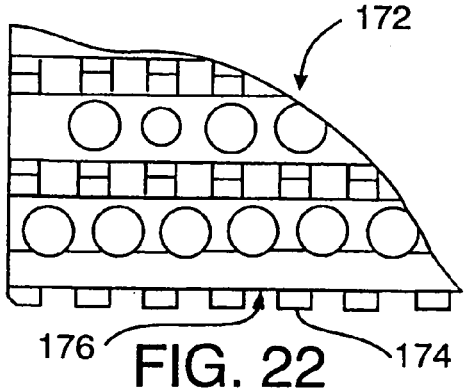
FIG. 22 is a side elevation view of a fragment of the front portion of the accessory rail mount exemplified in FIG. 21.

Such rail mount structures 172 may be secured to long arms, for example to a rifle or shotgun 176 illustrated in FIG. 21 and as further disclosed in U.S. Pat. No. 6,655,069 issued to Paul Y. Kim and incorporated herein by reference. Other examples of rail structures 172, including Picatinny rails, on other types of firearms are disclosed in U.S. Pat. Nos. 6,508,027 and 6,622,416, both issued to Paul Y. Kim and incorporated herein by reference; and in U.S. patent application Ser. No. 10/447,874 of Paul Y. Kim and John W. Matthews, assigned to the assignee of the present invention and incorporated herein by reference.

Figure 23:
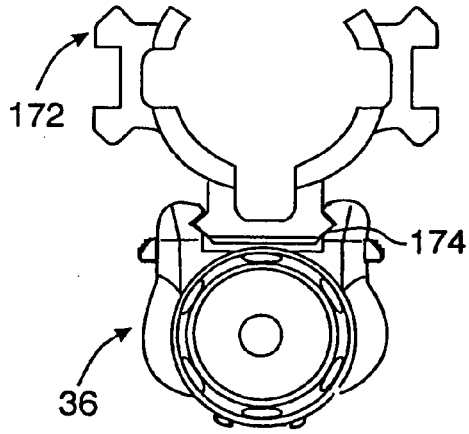
FIG. 23 is a front elevation view of the accessory rail mount of FIG. 22 to which is mounted a light beam generator according to the present invention.

As shown in FIGS. 21 and 23, the accessory device or light beam generator 36 may be removably secured to such rail structures 172 secured to firearms other than hand weapons. Where such rail structure 172 is of a type having Picatinny rails, the latch plate 80' shown in FIG. 20 would be installed in the accessory device 36, with the transverse protrusion 34' having a width w' for matingly engaging any one of the Picatinny rail slots 176. The accessory device 36 may be removably secured to the rail structure 172 in substantially the same way as the accessory device 36 may be removably secured to the rail 30 carried by the handgun 20. The operator may adjust the longitudinal position of the accessory 36 on the rail by depressing the handles 120 until a selected slot 176 has been encountered by the protuberance 34.

As shown in FIG. 21, a handgrip 180 may be secured to the rail structure 172, rearwardly of the light beam generator 36 but in proximity with the tail cap for permitting the operator to conveniently operate the tail cap switch device. In addition, FIG. 21 shows a tape switch 164 connected to the tail cap and having an actuator horseshoed about the front of the handgrip 180. In such configuration, and if both the accessory device 36 and the handgrip 180 are secured to the bottom rail 172 (as illustrated in FIG. 23), the tail cap switch 48 may be actuated in both the CONSTANT ON/OFF and MOMENTARY ON modes with either hand.

The accessory device or light beam generator 36 of the present invention, and in particular the housing 40, elongate members 94, pivot plate 80 and tail cap 50 may be manufactured using fabrication methods well-known in the art, of well known materials typically used in the art of making such components including rigid and durable materials such as polymeric materials as well as light weight aluminum alloys.

Although a target illuminator embodiment of the light beam generator 36 is described above in detail, laser aiming devices securable to rails carried by firearms are included within the scope of light beam generators according to the present invention.

Thus, there has been described a preferred embodiment of an accessory device which is removably securable to a longitudinal rail carried by a firearm, and which accommodates longitudinal rails of different configurations carried by firearms. The light beam generator of the preferred embodiment includes a removable tail cap switch actuable by either hand of an operator for placing the switch in CONSTANT ON/OFF positions and in a MOMENTARY ON position, as well as for remote actuation by either hand to a MOMENTARY ON position. Other embodiments of the present invention, and variations of the embodiments presented herein, may be developed without departing from the essential characteristics thereof. Accordingly, the invention should be limited only by the scope of the claims listed below.

I claim:

1. An accessory device for a firearm including a frame, a longitudinal barrel, a longitudinal rail carried by the frame, and a depression in the rail, the accessory device comprising:

a housing;

elongate members removably secured to said housing, said elongate members complementing the rail for enabling said housing to be retainably slid along the rail; and a plate pivotally secured to said housing and including a portion adapted to be received by the depression for stopping sliding of said housing along the rail.

2. The accessory device according to claim 1, wherein: said plate is removable from said housing.

3. The accessory device according to claim 1, wherein:
said plate is removably secured to said housing about a transverse pivot axis.

4. The accessory device according to claim 1, including:
a light emitter assembly carried by said housing;
a battery carried by said housing in circuit for energizing said light emitter assembly when switch actuated; and
a switch device including a switch actuator for said battery.

5. The accessory device according to claim 4, wherein:
said switch device is removably secured to said housing.

6. The accessory device according to claim 2, wherein:
said plate is captured to said housing by said elongate members secured to said housing, and said plate is removable from said housing when said elongate members are removed from said housing.

7. The accessory according to claim 6, wherein:
said plate is removable from said housing when said elongate members are removed from said housing.

8. The accessory device according to claim 2, wherein:
said plate includes transversely extending arms through said housing, said arms captured to said housing by said elongate members secured to said housing.

9. The accessory device according to claim 8, wherein:
said arms are adapted to be urged by an operator for pivoting said plate toward said housing.

10. The accessory device according to claim 8, wherein:
said housing is adapted for releasing said arms from capture to said housing when said elongate members are removed from said housing.

11. The accessory device according to claim 10, wherein:
said plate is adapted for being removed from said housing when said arms are released from capture to said housing.

12. The accessory device according to claim 4, wherein:
said switch actuator is rotatably urgeable by either hand of an operator when said housing is installed on the rail for placing said switch device in a CONSTANT ON or OFF position, and longitudinally urgeable by either hand of the operator when said housing is installed on the rail for placing said switch device in a MOMENTARY ON position.

13. The accessory device according to claim 12, including:
a remote switch actuator communicating with said switch device for remotely actuating said switch device to a MOMENTARY ON position.

14. The accessory device according to claim 4, wherein:
said switch device comprises a tail cap switch pivotally secured to said housing about a pivot axis, said tail cap switch pivotable about said pivot axis away from said housing.

15. A method of assembling an accessory device for installation on a rail having a depression and carried by a firearm, comprising:
providing the accessory device including a housing;
providing elongate members complementing the rail;
providing a plate including a portion adapted for being received by the depression in the rail;
pivotally securing said plate to said housing; and
removably securing said elongate members to said housing with said elongate members capturing said plate to said housing and enabling said housing to be retainably slid along the rail.

16. The method according to claim 15, wherein:
in the plate providing step, said plate is removably securable to said housing about a transverse axis.

17. The method according to claim 15 wherein the rail is a first rail, further including:
removing said elongate members from said housing;
removing said plate from said housing;
providing a second plate including a portion adapted for being received by a depression in a second rail carried by a firearm;
pivotally securing said second plate to said housing; and
removably securing said elongate members to said housing with said elongate members capturing said second plate to said housing and enabling said housing to be retainably slid along the second rail.

18. The method according to claim 17, wherein:
the depression in the second rail is of a different size than the depression in the first rail.

19. A method of adapting an accessory device normally installable on a first rail carried by a firearm and having a depression, for installation on a second rail carried by a firearm and having a depression of a different size than the depression in the first rail, comprising:
providing the accessory device including a housing, a first plate including a portion adapted for being received by the depression in the first rail, said plate being removably pivotally secured to said housing, and elongate members complementing the first rail and removably secured to said housing and capturing said plate to said housing, said elongate members enabling said housing to be retainably slid along the first rail;
removing said elongate members from said housing;
removing said first plate from said housing;
providing a second plate including a portion adapted for being received by the depression in the second rail;
removably pivotally securing said second plate to said housing; and
removably securing elongate members complementing the second rail to said housing and capturing said second plate to said housing and enabling said housing to be retainably slid along the second rail.

20. The accessory device according to claim 2, wherein:
said plate is selected from a plurality of plates including portions respectively adapted to be received by differently sized depressions in different rails.

21. An accessory device for a firearm including a frame, a longitudinal barrel, a longitudinal rail carried by the frame, and a depression in the rail, the accessory device comprising:
a housing;
elongate members secured to said housing, said elongate members complementing the rail for enabling said housing to be retainably slid along the rail; and
a latch member removably secured to said housing and including a portion adapted to be received by the depression for preventing sliding of said housing along the rail.

22. The accessory device according to claim 21, wherein:
said latch member is removably secured to said housing.

23. The accessory device according to claim 22, wherein:
said latch member is selected from a plurality of latch members including portions respectively adapted to be received by differently sized depressions in different rails.

24. The accessory device according to claim 21, wherein:
said latch member comprises a plate including said portion.

25. The accessory device according to claim 22, wherein:
said latch member is captured to said housing by said elongate members secured to said housing.

26. The accessory device according to claim 25, wherein: said latch member is removable from said housing when said elongate members are removed from said housing.

27. The accessory device according to claim 21, wherein: the securement of said elongate members is transversely adjustable.

28. The accessory device according to claim 21, wherein: said elongate members are secured to said housing with headed screws retained in bores in said elongate members respectively communicating with threaded bores in said housing, said bores in said elongate members providing a loose fit with said headed screws at lest in the transverse direction for adjusting the transverse distance between said members.

29. The accessory device according to claim 21, wherein: a light emitter assembly carried by said housing;

a battery carried by said housing in circuit for energizing said light emitter assembly when switch actuated; and a switch device including a switch actuator for said battery.

30. The accessory device according to claim 29, wherein: said switch device is removably secured to said housing.

31. The accessory device according to claim 29, wherein: said switch actuator is rotatably urgeable by either hand of an operator when said housing is installed on the rail for placing said switch device in a CONSTANT ON or OFF position, and longitudinally urgeable by either hand of the operator when said housing is installed on the rail for placing said switch device in a MOMENTARY ON position.

32. The accessory device according to claim 31, including:

a remote switch actuator communicating with said switch device for remotely actuating said switch device to a MOMENTARY ON position.

33. The accessory device according to claim 21, wherein: said switch device comprises a tail cap switch pivotally secured to said housing about a pivot axis.

34. The accessory device according to claim 21, wherein: said tail cap switch is adapted to be removed by an operator from its securement about said pivot axis when said tail cap switch is pivoted away from said housing.

35. A method of assembling an accessory device for installation on a rail having a depression and carried by a firearm, comprising:

providing the accessory device including a housing;

providing elongate members complementing the rail;

providing a latch member having a portion sized for being received by the depression in the rail;

securing said latch member to said housing; and removably securing said elongate members to said housing with said elongate members capturing said latch member to said housing and enabling said housing to be retained along the rail.

36. The method according to claim 35, wherein the rail is a first rail, further including:

removing said elongate members from said housing;

removing said latch member from said housing;

providing a second latch member having a portion sized for being received by a depression in a second rail carried by a firearm;

securing said second latch member to said housing; and removably securing said elongate members to said housing with said elongate members capturing said second latch member to said housing and enabling said housing to be retained along the second rail.

* * * * *

UNITED STATES PATENT AND TRADEMARK OFFICE

CERTIFICATE OF CORRECTION

PATENT NO. : 7,360,333 B2
APPLICATION NO. : 11/436293
DATED : April 22, 2008
INVENTOR(S) : Paul Y. Kim It is certified that error appears in the above-identified patent and that said Letters Patent is hereby corrected as shown below:

At column 16, line 48, --removably-- should be inserted before "secured"

line 51, "removably" should be deleted before "secured"

At column 17, line 12, "at lest" should be changed to --at least-- line 15, "wherein" should be changed to --including--

At column 18, line 1, "claim 21" should be changed to --claim 29-- line 4, "claim 21" should be changed to --claim 33--

Signed and Sealed this

Twentieth Day of July, 2010

David J. Kappos

David J. Kappos
*Director of the United States Patent and Trademark Office*